United States Patent [19]

Grayek

[11] Patent Number: 4,516,668

[45] Date of Patent: May 14, 1985

[54] KNOCK-DOWN COMBINATION HANDBAG AND MAT AND METHOD OF MAKING SAME

[76] Inventor: Rose M. Grayek, 33 Happy Hollow Cir., Stratford, Conn. 06497

[21] Appl. No.: 546,278

[22] Filed: Oct. 28, 1983

[51] Int. Cl.[3] ..... A47C 17/82

[52] U.S. Cl. ..... 190/2; 190/1; 190/107; 190/115; 190/126; 5/417; 383/4

[58] Field of Search ..... 190/1, 2, 107, 115, 190/126; 150/28 R, 28 A, 29, 32; 5/417, 418, 419, 420; 383/4

[56] References Cited

U.S. PATENT DOCUMENTS

| | | | |
|---|---|---|---|
| 3,045,261 | 7/1962 | Hocherman | 190/2 |
| 3,477,552 | 11/1969 | Goldman | 190/2 |
| 3,550,663 | 12/1970 | Johnston | 150/28 A |
| 3,768,610 | 10/1973 | Housel | 190/115 |
| 3,797,043 | 3/1974 | Brument | 383/4 |
| 3,830,348 | 8/1974 | Ohyama | 190/107 |
| 4,101,994 | 7/1978 | Hoyt | 383/4 |
| 4,112,991 | 9/1978 | Barbaresi | 150/28 A |
| 4,154,323 | 5/1979 | Sneider | 190/2 |
| 4,188,988 | 2/1980 | Agyagos | 190/2 |
| 4,197,891 | 4/1980 | Comollo | 190/2 |
| 4,375,111 | 3/1983 | Hall | 190/2 |
| 4,437,549 | 3/1984 | Gibbs | 190/126 |

*Primary Examiner*—Joseph Man-Fu Moy
*Assistant Examiner*—David T. Fidei
*Attorney, Agent, or Firm*—Arthur T. Fattibene

[57] ABSTRACT

A combination knock-down handbag and mat which is formed of a blank of sheet material of a predetermined length and width which is peculiarly seamed and secured so that in the assembled or folded position, the blank forms a handbag and in the unfolded position the blank defines a mat, e.g. a beach mat. To form the mat, which can be subsequently formed into a handbag, one end of the blank is initially reversely folded onto a portion of the blank and secured thereto to define one or more open end pockets. A handle is secured to the open end of the pocket. To convert the mat into a handbag the remainder or extended portion of the blank is reversely folded in accordian fashion to the size and shape of the reversely folded portion. The opposed end portions of the folded blank thus folded are then folded relative to the central portion thereof. With the blank so folded, the central pocket thus formed is turned inside out to define the handbag in the final folded position of the blank. In the unfolded position, the blank forms a mat.

10 Claims, 13 Drawing Figures

FIG. 1
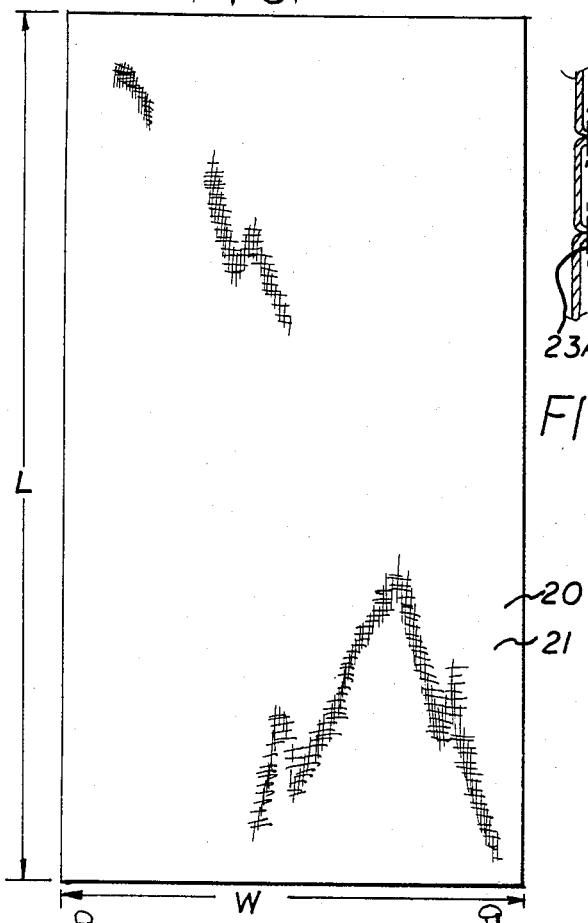
FIG. 2
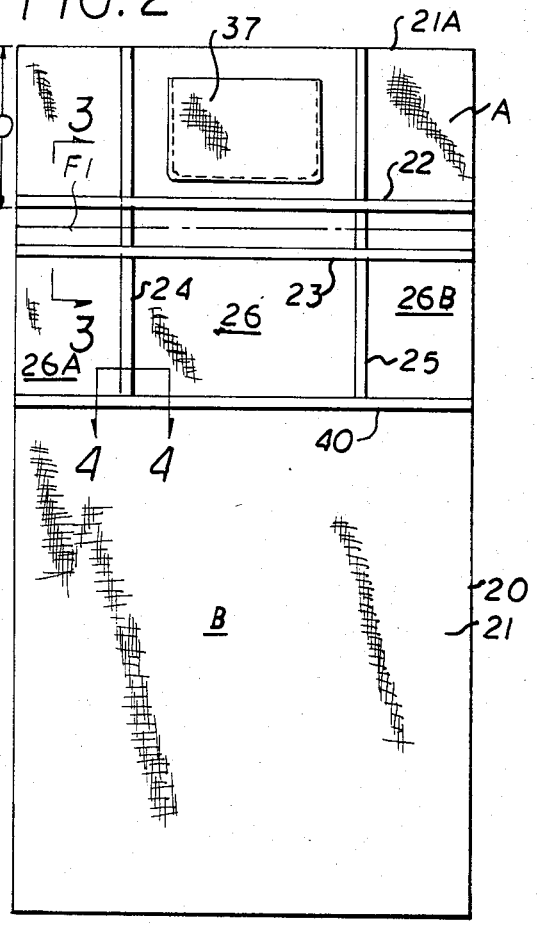
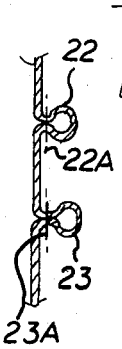
FIG3
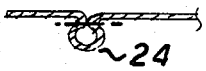
FIG. 4
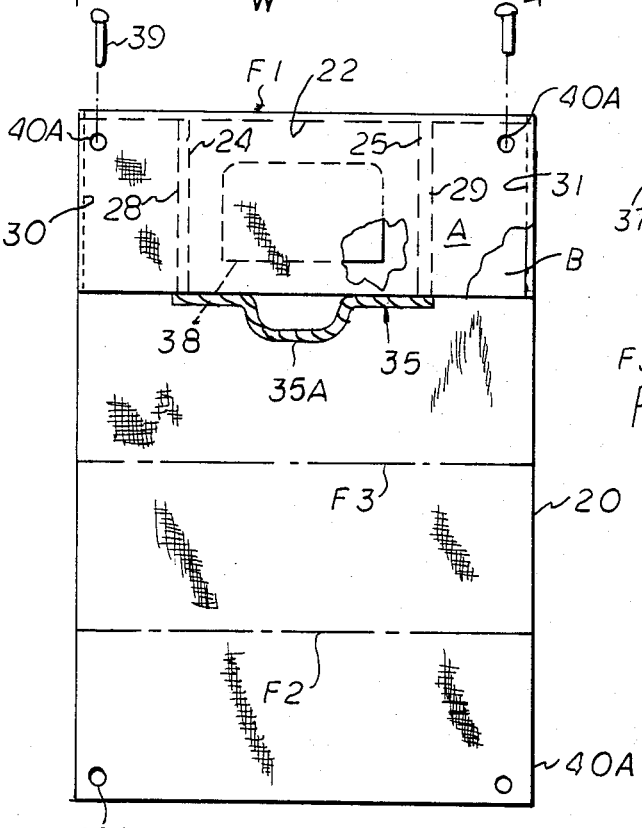
FIG. 5
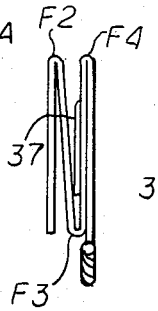
FIG. 7
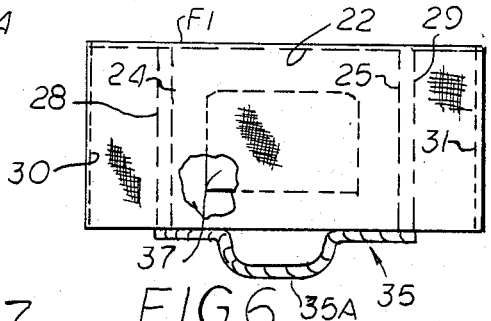
FIG6
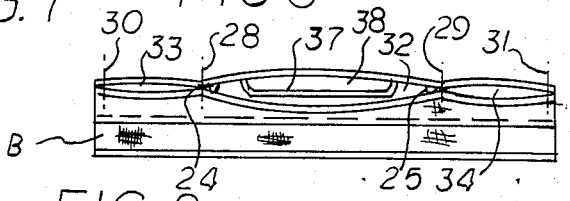
FIG. 8
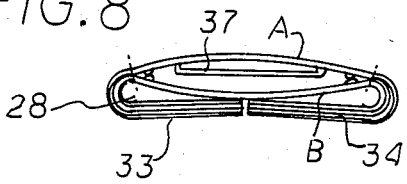
FIG. 9

KNOCK-DOWN COMBINATION HANDBAG AND MAT AND METHOD OF MAKING SAME

This invention is directed to a combination known-down handbag and mat comprising a blank 20 of foldable sheet material, such as a towel or blanket 21 which in the assembled position can be folded so as to define a portable handbag as seen in FIG. 11 and which in the unfolded position can be utilized as a mat or towel upon which one can lie as seen in FIG. 5.

PRIOR ART AND PURPOSE OF THE INVENTION

Heretofore, various efforts have been made to provide an article which can be utilized in one form as a mat or towel, and which can be used in another form as an article having a different utility. Some of the prior known efforts directed to various articles having dual utility are disclosed in the U.S. Pat. Nos. 124,007; 1,256,783; 1,696,362; 1,741,156; 1,930,942; 2,038,335; 2,044,717; 2,045,784; 2,264,471; 2,659,494 and French Pat. No. 693,192. However, such previous known articles generally require an additional device, as for example a preformed container or receptacle, in which the mat or towel can be placed after folding and hence are not really directed to a unitary article having dual utility as two distinct and separate devices which is readily made of a single or unitary piece of material in which one can be carried in the other.

In constrast to the prior known devices, the invention hereafter described is directed to a unitary foldable blank of sheet material which is formed and constructed so that it can be actually used as a handbag for storing other articles in the folded position of the blank; and as a mat in the unfolded position of the blank. Thus, it is one at the same time a towel or an extended mat when unfolded and as a container or handbag for the mat in the folded position and in which other articles may be carried.

The subject matter of the invention has particular application as an accoutrement for bathing and it is particularly useful for use on beaches, where it may be used in the unfolded position as a mat or towel on which to lie, and alternately in a folded position as a handbag in which the mat and other articles or items of apparel and comfort may be carried that are usually utilized at a beach or resort area.

OBJECTS

It is an object of this invention to provide a mat or towel or sheet of material which can be readily folded and formed into a unique handbag having one or more pockets in which other articles may be stored in a folded position of the blank, and which in the unfolded position of the blank can be utilized as a mat or towel to lie upon.

In another object to provide a combination handbag and towel or mat, formed of a unitary blank or sheet material which is specifically formed and secured so as to define one or more internal pockets in the folded position thereof.

Another object of the invention is to provide an article of manufacture which is relatively simple and inexpensive to manufacture, and which is positive in operation.

A BRIEF SUMMARY OF THE INVENTION

The foregoing objects and other features and advantages of this invention are obtained by a blank of flexible sheet material having a predetermined length and width which can be readily folded to define a handbag in the folded position, and which in the unfolded position of the blank defines a mat upon which one can lie, as at a beach. The combination handbag and mat is formed by first forming a pair of spaced apart transversely extending seams formed in the plane of the blank or sheet material at a point intermediate the length thereof. The transverse seams so formed are spaced a distance from one end or edge of the blank, an amount substantially equal to the depth of the desired assembled bag. A second pair of spaced apart seams are formed in the plane of the blank so as to extend longitudinally thereof from the previously defined edge or end of the blank a distance equal to substantially twice that the depth of the assembled handbag. Accordingly, the end portion of the blank adjacent said edge is folded along a transverse fold line disposed between first transverse pair of seams so as to be reversely folded onto an adjacent portion of the blank of material. The reversely folded portion is then secured to the adjacent portion of the blank of material by any suitable means, such as e.g. stitching or fusing, to define one or more open end pockets. A cord or handle is attached to the open end of the pocket so formed. The extending portion of the blanket or mat is then reversely folded to the size and shape of the reverse folded portion. The opposed end portions of the folded blank are then reversely folded relative to the central portion thereof to the size of the handbag to be formed. With the blank of material thus secured and folded, the bag is formed by grasping the inside end corners of the central pocket and turning the pocket inside out. In so doing, the transverse seams define the bottom and side edges of the folded handbag. To form the mat, the handbag is unfolded in the reverse manner to its expanded position.

FEATURES

A feature of this invention resides in the provision that the combination handbag and mat can be formed from a single unitary blank of foldable sheet material.

Another feature of this invention resides in the provision that the handbag may be provided with one or more internal pockets for receiving and storing various articles.

Another feature of this invention resides in the provision that a patch pocket may be secured to one side of the assembled handbag to form another pocket for carrying various articles.

Another feature of this invention resides in providing stakes for securing mat in the unfolded position to the ground.

Other features and advantages will be more readily apparent when considered in view of the drawing and detailed description in which:

FIG. 1 is a plan view of an expanded blank of foldable sheet material from which the combination handbag and mat is formed.

FIG. 2 is a plan view of the sheet material of FIG. 1 in which a pair of transversely and longitudinally extending seams have been formed in accordance with this invention.

FIG. 3 is a detail sectional view taken on line 3—3 on FIG. 2.

FIG. 4 is a section view taken on line 4—4 on FIG. 2.

FIG. 5 is a plan view of the unitary sheet of material as shown in FIGS. 1 and 2 illustrated in its assembled and unfolded position to define the mat upon which one can lie.

FIG. 6 is a view of the mat of FIG. 3 illustrated in the intermediate folded position to form the handbag.

FIG. 7 is an end view of FIG. 6 to illustrate the intermediate folds.

FIG. 8 is a front end view of the folded mat position of FIG. 6.

FIG. 9 is a front view illustrating another intermediate folded position to illustrate the relative position of the folds immediately prior to the final step in forming the handbag.

DETAILED DESCRIPTION

Figure 11:
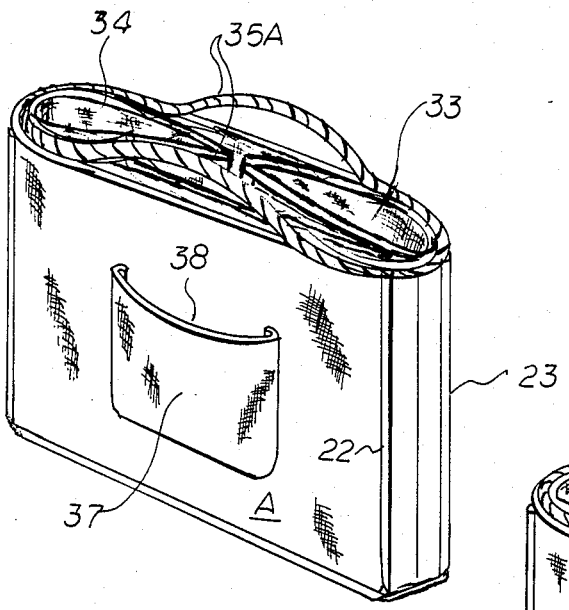
FIG. 11 is a perspective view of the assembled handbag.

Referring to the drawings, and more particularly to FIG. 1, there is illustrated a single piece of foldable sheet material, e.g. a towel or terrycloth type material or blanket material 20 which is cut in a rectangular shape 21 having a predetermined with "W" and a predetermined length "L". It will be understood that the length and width may assume any suitable dimension and that the foldable material may comprise any suitable type of material such as fabric or plastic. With the sheet material 21 disposed in its expanded position, as shown in FIG. 1, a transversely extending bead-line seam 22 is formed in the plane of the blank 20 at a distance D measured in one edge or end 21A or the sheet 21. The distance "D" defines the depth of the handbag in the folded position as it will become hereafter more apparent. A second seam 23 is formed parallel and spaced from seam 22 to define a pair of transversely extending beadlike seams intermediate the length of sheet 21.

It will be noted that the seams 22, 23, extending transversely of the sheet 21, are formed by a pinch fold and securing said folds to define the seams 22 and 23. As shown in FIG. 3, the bead seams 22, 23 are formed by a pinch type pleat with the folds of the pleat secured by a sewn seam 22A, 23A. If the sheet 21 is formed of plastic, the seams may be formed by fusion, heat sealing or sonic welding.

A second pair of seams 24,25 are similarly formed in the plane of the sheet 21 so as to extend longitudinally thereof from the edge 21A of the sheet 21. While the spacing of the longitudinally extending seam 24, 25 is not critical, the arrangement is such that the pair of seams 24, 25 divides the sheet into a central part 26 and a pair of outer parts 26A, 26B; the outer parts 26A, 26B being generally equal in width. If desired, a third transverse seam 40 may be formed across the blank perpendicular to the ends of the longitudinal seams 24 and 25. Seams 24, 25 and 40 are a pinch fold beaded seam similar to seams 22, 23.

As best seen in FIG. 5, the end portion A of the sheet 21 is reversely folded about a transverse fold line $F_1$ which extends between a pair of transverse beaded seams 22, 23, so that in the folded position the beaded seams 22, 23 are disposed between the folded portion A and the underlying portion B of the sheet 21, and extends parallel thereto. Seam 40 in the folded position of the bank defines a beaded seam along one edge of the pocket formed by the reverse folding of portion A into portion B of the sheet. As best seen in FIG. 5, reverse portion A of the sheet or blank 21 is secured to the adjacent portion B of the sheet by suitable securing means, as for example a threaded stitch. In the illustrated embodiment, the securing means comprises a first pair of seams 28,29 spaced just outwardly of the inturned longitudinally extending beaded seam 24, 25. A second pair of seams 30,31 extend along the outer longitudinal edge portion of the blank or sheet 21 so as to secure the reversely folded portion A to the underlying portion B of the blank or sheet. Thus, in the form of the invention shown in FIG. 5, the securing means 28, 29, 30 and 31 define a central open ended pocket 32 and a pair of open end pockets 33, 34 disposed to either side of the central pocket 32.

In accordance with this invention, a handle means 35 in the form of a cord 35A is connected to the open end of the central pocket 32, e.g. by sewing. If desired, a patch 37 may be secured to portion A in the area of the central pocket portion, as indicated in FIGS. 2 and 8, to define an extra external pocket 38 when the sheet 21 is folded in the handbag position as noted in FIG. 11.

When the sheet 21, formed as described, is unfolded, as shown in FIG. 5, it is in a position to be utilized as a blanket or mat upon which one may lie. If desired, the article as disclosed in FIG. 5 may be positively secured to the ground by providing holding stakes 39 which may be inserted through the corner portions of the sheet 21 formed as described. Grommets as indicated at 40A may be used to define the stake holes for securing the mat in the form shown in FIG. 5.

To convert the mat, as shown in FIG. 5, to a handbag position, as indicated in FIG. 11, the extended portion B of the mat is reversely folded about transverse fold lines $F_2$, $F_3$ and $F_4$ in an accordian type series of folds so as to conform the extended portion B of the mat to the size and shape defined by the reversely folded end portion A, as best seen in FIGS. 7 and 8. With the extended portion B thus folded relative to the reversely folded portion A, as shown in FIGS. 7 and 8, the opposed outer pocket portions are reversely folded relative to the central pocket portion 32, as best seen in FIG. 9. To free the handbag after the blank or mat has been folded, as indicated in FIG. 9, one need only to place one's hands into the central pocket portion, i.e. between the reversed folds of portions A and B and grasp the opposed corner portions X and Y of the central pocket, and turn the pocket 32 inside out so that the outer pocket 33 and 34 and the accordian folded portion are now inside the central defined pocket 32, and the handle means 35 circumscribe the open end of the central pocket 32 (see FIG. 11). In the inside out position as described, the transverse beaded seams 22, 23 define the external bottom and sides of the folded handbag, as best seen in FIG. 11; and the outer pockets are disposed within the central pocket 32 to define internal compartments for receiving various articles which one may wish to carry or store in the formed handbag. Also, the patch pocket 38 is disposed to the outer side of the folded handbag position of the sheet.

The entire assembly after assuming the shape of the handbag, as herein described, is carried by a core handle 35A which is formed by sewing either a continuous loop of cord about the open end of the central pocket portion, or by sewing a length of cord to each opposed edge of the central pocket. It will be noted that the cord loop is affixed to the main body portion of the article by suitable stitching to the free edge of the central pocket 32; with the central portion of the cord being unattached to define a handle. The construction is such that when the unit is turned inside out to form the handbag, both sides of the bag are supported by the handles 35, there being no stitching formed in the intermediate portion of the cord, thus providing a convenient handle grip 35A as can be readily noted in FIG. 11. It will thus be apparent that the manner of transforming the beach mat, formed as shown in FIG. 5, into the handbag or recepticle as shown in FIG. 11, is extremely simple and positive in operation.

It will be understood that further embellishments may be formed, e.g. the opposed edges of the blank or sheet may be hemmed to provide a finished edge of the periphery of the sheet prior to forming the same as hereinbefore described. Also, the grommets may be omitted if desired. If desired, the manner and location of the seams can be varied without department from the inventive concept described.

Figure 12:
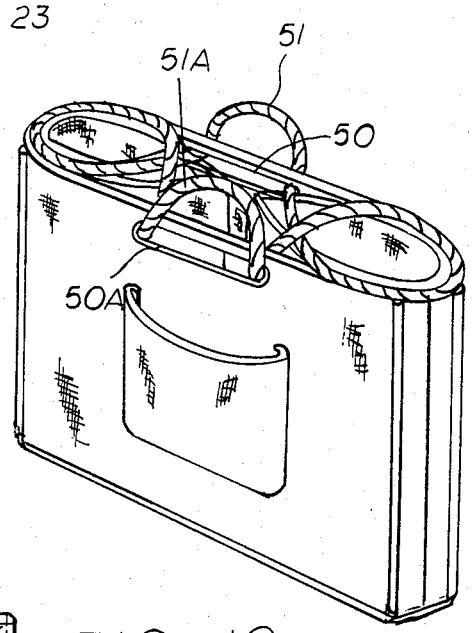
FIG. 12 is a perspective view of a modified detail of construction.
Figure 10:
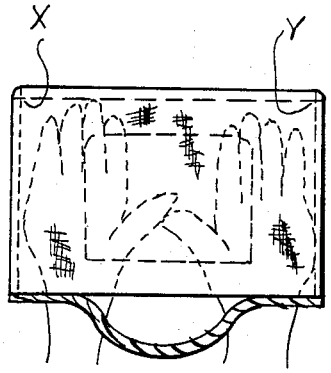
FIG. 10 illustrates a top plan view of FIG. 9 showing the placement of one's hands for turning the pocket inside out to form the handbag.
Figure 13:
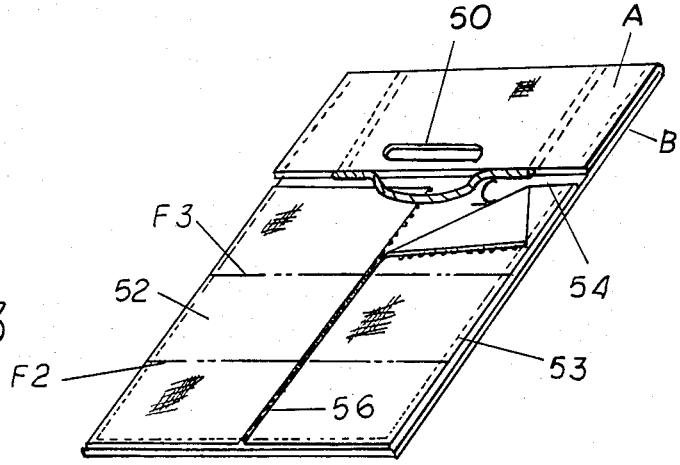
FIG. 13 is a modified embodiment illustrating the invention applied to a sleeping bag type mat.

FIG. 13 illustrates a modified construction of the invention described whereby a means is provided to lock or secure the open end of the handbag in the assembled position. This is attained by providing the reversely folded end portion A of the blank with a slit 50 which is illustrated in the form of the invention shown in FIG. 13. The portion of the blank B subjacent to the folded portion A is also provided with a similar opposed slit 50A. As shown the respective slits 50 and 50A are formed adjacent the upper end of the handbag side defining portions. It will be understood that slits 50 and 50A may be formed in the form of the invention disclosed in FIGS. 1 to 11 in the same manner as shown in FIGS. 12 and 13.

As best seen in FIG. 13, the open end of the assembled handbag can be secured or drawn to a substantially closed position by extending the handle loop pr portion 51 opposite slit 50 through the slit 50. Similarly, handle grip or loop 51A opposite slit 50A is criss-cross through slit 50A so that when the handbag is carried the hand grips 51, 51A being criss-crossed through its respective slit function to effect a closing or a drawing of the open portion of the bag together, and thus tends to close or seal the open end of the assembled handbag to secure the contents therein. FIG. 12 illustrates the manner in which the handle grips 51, 51A are criss-crossed to effect a closure for the assembled handbag.

FIG. 13 illustrates another modified construction. The extended portion of the blank as indicated at C is provided with a cover sheet 52. It will be understood that the cover sheet 52 may be a separate sheet or may be an extension of portion C which is reversely folded thereto. In the illustrated embodiment, the cover sheet 52 is a separate sheet which is suitably secured by any suitable means, e.g. sewing about a peripheral seam 53, so as to define an open end 54. In the illustrated embodiment, the cover sheet may be longitudinally split as at 55 to define access to the pocket formed. The slit is provided with a suitable slide fastener 56 whereby the cover sheet can be readily parted and reparted. Thus, in this form the the invention, the mat portion can be formed into a sleeping bag type mat by the addition of the cover sheet 52 as described.

It will be understood that the construction of FIG. 13 can be readily folded to define a handbag assembly in the manner herein before described with respect to FIGS. 1 to 11.

When the blank of FIGS. 5 and 13 is used in its mat or sleeping bag position as shown, the center pocket portion defined by the reversely folded portions A and B may be filled with clothing or the like to form a pillow for added comfort.

While the invention has been described with respect to a specific embodiment, variations and modifications may be made without departing from the spirit or scope of the invention.

What is claimed is:

1. A combination knock-down handbag and mat comprising a blank of foldable sheet material of a predetermined length and width which in the folded position thereof defines a handbag and in the knockdown position thereof a mat;

means defining a first pair of spaced apart seams extending transversely the width of said blank at a point intermediate the length of said blank and spaced from a transverse end thereof a distance equal to substantially the depth of the assembled handbag;

means defining a second pair of spaced apart seams extending longitudinally of said blank from said transverse end a distance substantially equal to twice the depth of the assembled handbag;

said blank of sheet material being reversely folded transversely along a foldline disposd intermediate said first pair of transversely extending seams to define a doubled-over portion whereby said second pair of seams are deposed between said doubled-over portion; and an extended portion;

means for securing the doubled-over portion to one another to define a pocket having an open end;

said extended portion of said blank being reversely folded along a transversely extending foldline whereby said extending portion is gathered in one or more folds substantially equal in depth to the said doubled-over fold and disposed contiguous and congruent to said doubled over portion;

said contiguous folds and doubled over portion defining a center portion and opposed end portions whereby said end portions are reversely folded relative to said center portion and disposed contiguous thereto, and said pocket being turned inside out to define the assembled handbag whereby said reversely folded end portions are disposed within said pocket.

2. A combination knock-down handbag and mat as defined in claim 1 wherein said means for securing said doubled-over portion comprises a pair of seams securing the doubled-over portion to one another to form a pocket open at one end between said seams.

3. A combination knock-down handbag and mat as defined in claim 2 wherein said securing means for said doubled over portion comprising a second pair of seams, each of said second pair of seams securing the ends of said doubled-over portion to each other, to define opposed end pockets adjacent said first mentioned pocket.

4. A combination knock-down handbag and mat as defined in claim 2 and including a handle means secured to the open end of said pocket.

5. A combination knock-down handbag and mat as defined in claim 4 wherein said handle means includes a cord circumscribing the open end of said pocket, said cord having an unsecured portion to define a hand grip.

6. A combination handbag and mat comprising a single blank of foldable sheet material having a predetermined length and width which in a folded position defines a handbag and in the unfolded position a mat;

one end portion of said blank being reversely folded onto an intermediate portion of said blank about a foldline extending transversely of said blank to define a doubled-over portion, and an extended portion;

seams for securing said reversely folded one end portion to said intermediate portion of said blank;

said securing means including a pair of spaced apart seams disposed intermediate the width of said doubled-over portion and extending longitudinally of said blank in the folded position to define a central open end pocket;

and a second pair of seams for securing the adjacent outer edge portion of said reversely folded end portion to said intermediate portion to define an opposed open end pocket disposed to either side of said central open pocket;

means defining a handle secured to said central pocket;

said extended portion of said blank being folded about a transverse foldline in an accordian like fold to a size and shape conforming to the reversely folded end portion so as to be disposed contiguous and congruent to said reversely folded end portion;

said opposed end pockets and contiguous accordian folds being reversely folded relative to said central pocket so as to be disposed contiguous to said central pocket and into overlying relative relationship therewith;

and said central pocket being turned inside out whereby the opposed end pockets and said accordian fold are disposed within said central pocket, whereby said end pockets define separate and distinct storage pockets within said central pocket in the folded position of said blank.

7. A combination handbag and mat as defined in claim 6 and including a slit formed in said one end portion of the blank and in said adjacent contiguous intermediate portion of said blank for receiving the opposite handle means for interlocking said handle means in the assembled position of the handbag to define a closure for said central pocket.

8. A combination handbag and mat as defined in claim 1 and including a cover sheet connected to said extended portion of said blank, means for securing said cover sheet to said extended portion to define an open end sleeping bag portion in the unfolded position of said blank.

9. A combination handbag and mat as defined in claim 8 wherein said cover sheet is longitudinally separated along the length thereto, and fastening means for securing the adjacent separated portion of said cover sheet.

10. A combination knockdown handbag and mat comprising a single blank of foldable sheet material of a predetermined length and width which in the folded position of said blank defines a handbag and in the knockdown position thereof a mat, one end of said blank being reversely folded onto an intermediate portion of said blank of sheet material about a foldline extending transversely of the width of said blank to define a doubled over portion; and an extended portion, a plurality of seams securing said reversely folded one end portion to said intermediate portion, said seams being transversely spaced across the width of said doubled over portion, and said seams extending in the longitudinal direction of said blank, at least two of said plurality of seams securing the adjacent outer edge portions of said reversely folded end portion to said intermediate portion, and the remainder of said seams being spaced between said two seams to define a plurality of open end pockets, handle means connected to one of said pockets, whereby said extended portion of said blank is adapted to be folded in an accordian like fold about a transverse fold line and reversely folded to a size and shape conforming to one of said pockets, and said one pocket being turned inside out so that said accordian folded extended portion and the other of said pockets are disposed within said one pocket in the folded position of said blank.

* * * * *